US005366391A

United States Patent [19]

Deiss

[11] Patent Number: 5,366,391

[45] Date of Patent: Nov. 22, 1994

[54] CONNECTOR USING STANDARD HOUSING AND MODIFIED SOCKET CONTACT

[75] Inventor: Werner Deiss, Waiblingen, Germany

[73] Assignee: ITT Corporation, New York, N.Y.

[21] Appl. No.: 159,019

[22] Filed: Nov. 29, 1993

[30] Foreign Application Priority Data

Dec. 1, 1992 [DE] Germany ..... 4240261

[51] Int. Cl.[5] ..... H01R 13/42

[52] U.S. Cl. ..... 439/740; 439/750

[58] Field of Search ..... 439/740, 744–749, 439/750

[56] References Cited

U.S. PATENT DOCUMENTS

| | | | |
|---|---|---|---|
| 3,031,639 | 4/1962 | Majewski | 439/740 |
| 3,122,407 | 2/1964 | Cowe | 439/740 |
| 3,143,385 | 8/1964 | Zimmerman, Jr. et al. | 439/744 |
| 3,980,385 | 9/1976 | Hirokawa et al. | 439/748 |
| 5,055,055 | 10/1991 | Bakker | 439/78 |
| 5,108,318 | 4/1992 | Sakurai et al. | 439/744 |

FOREIGN PATENT DOCUMENTS

| | | |
|---|---|---|
| 0079599 | 11/1982 | European Pat. Off. . |
| 1665164 | 10/1967 | Germany . |
| 2165675 | 6/1975 | Germany . |
| 2744155 | 9/1977 | Germany . |
| 3510895 | 3/1985 | Germany . |

*Primary Examiner*—Gary F. Paumen
*Attorney, Agent, or Firm*—Thomas L. Peterson

[57] ABSTRACT

A connector is described which uses a prior art standard housing but which uses a modified socket contact to enable reception of a long pin contact. The standard housing (7, FIG. 8) has a horizontal passage (28) with a rear end portion that has four ribs (9). The socket contact (4, FIG. 5) is a substantially cylindrical tube having a plurality of projections (13) on its outside that can pass between the housing ribs, with the socket contact then turned so the projections lie forward of the ribs to lock the socket contact in place. The projections permit the inside of the tube to be of substantially constant diameter to receive a long pin contact.

3 Claims, 5 Drawing Sheets

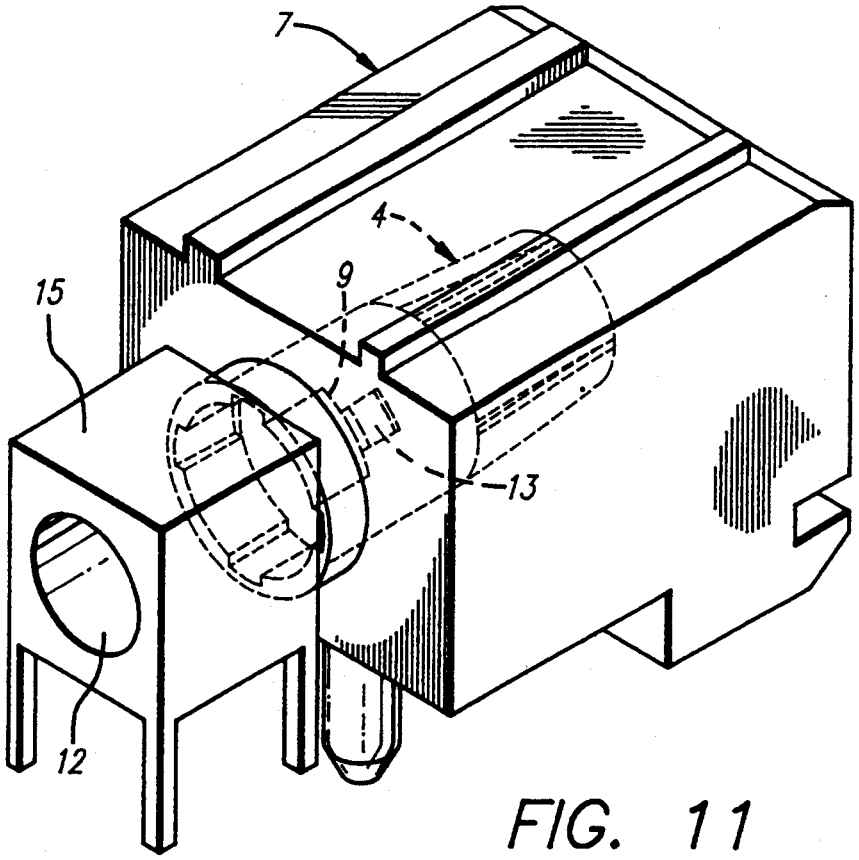
FIG. 11
FIG. 12
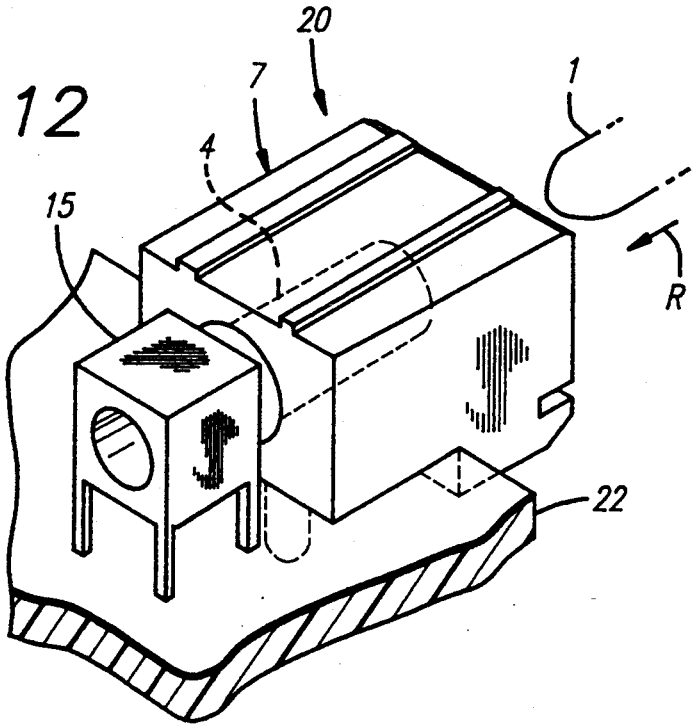

CONNECTOR USING STANDARD HOUSING AND MODIFIED SOCKET CONTACT

BACKGROUND OF THE INVENTION:

A prior art connector that is widely used in Germany, includes a standard insulative socket housing which is designed to receive a standard socket contact. The housing is constructed in accordance with standards identified as DIN 41 612, where DIN stands for "Deutsche Industrie Norm", which in English means "German Industrial Standard". The contact is identified by DIN 41 626. Since the standard housing is often specified, it is desirable to be able to use it. However, drawbacks have been found in the use of the standard socket contact that is designed to mount in the standard housing, and it would be desirable if an improved socket contact could be used which securely mounts in the standard housing.

The standard housing has front and rear ends and has a passage extending between the ends, The rear portion of the passage has internal ribs. The standard socket contact is in the form of a largely solid cylinder, with the front end having a cylindrical hole with slots therein to form pin-engaging tines. The middle of the socket contact, behind the cylindrical hole, has an external groove which receives a spring clip that is used to snap behind the ribs of the socket housing to hold the socket contact in place. This construction of the socket contact prevents the construction of a socket contact with a deeper hole at the front (or a through hole) that can receive a long pin contact, since the groove on the outside would result in very thin walls around the deepest parts of the hole. A through hole of substantially constant diameter could also be useful to pass a cable. A replacement socket contact, which could replace the standard socket contact, wherein the replacement socket contact could have a deep or through hole of substantially constant large diameter, would be of value.

SUMMARY OF THE INVENTION

In accordance with one embodiment of the present invention, a connector is provided which uses a standard connector housing, and which employs a socket contact that fits in the standard housing and that has a large diameter long or through hole without sacrificing strength. The socket contact comprises a substantially cylindrical tube having a front portion with slots forming tines for engaging a pin contact. The tube has a middle portion lying behind the front portion, and the middle portion has circumferentially spaced projections on its outside that can fit between the ribs at the rear of the standard housing. As the socket contact is moved forwardly into the standard housing, a collar on the socket contact abuts the rear of the housing, and at that time the projections lie immediately forward of the ribs. The socket contact is then turned so the projections lie against the front ends of the ribs to lock the socket contact in the housing.

The novel features of the invention are set forth with particularity in the appended claims. The invention will be best understood from the following description when read in conjunction with the accompanying drawings.

BRIEF DESCRIPTION OF THE DRAWINGS

FIG. 11 is a view similar to that of FIG. 10, but with the parts assembled.

FIG. 12 is an isometric view of the socket of FIG. 11, shown mounted on a circuit board.

DESCRIPTION OF THE PREFERRED EMBODIMENT

Figure 1:
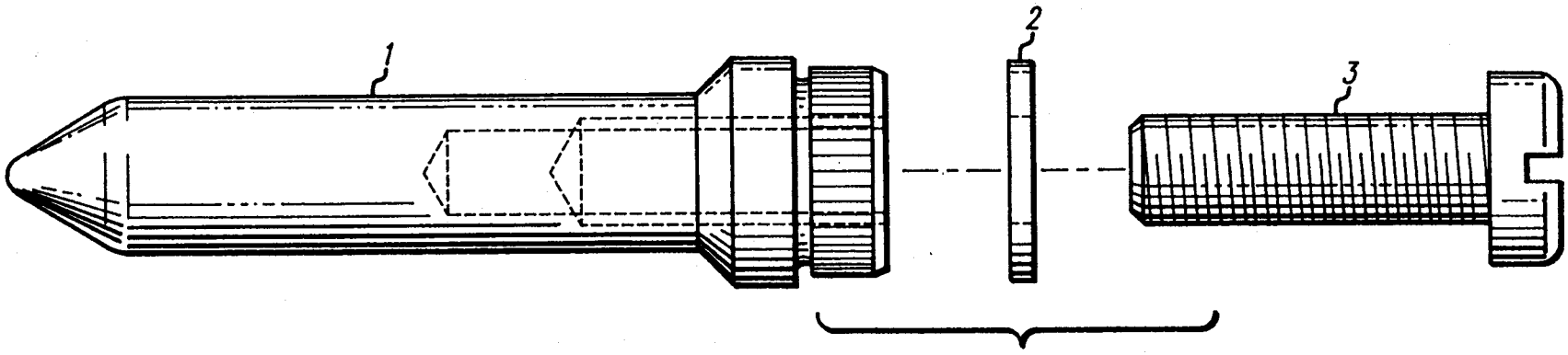
FIG. 1 is an exploded side elevation view of a pin contact constructed in accordance with one embodiment of the prior art.

FIG. 12 illustrates a connector 20 of the present invention, shown mounted on a circuit board 22. The connector includes a prior art insulative socket housing 7 and a new conductive socket contact 4 that is mounted in the housing. A circuit board connector device 15 is shown attached to the rear of the socket contact. The figure also shows a pin contact 1 which is being moved in a rearward direction R to mate with the socket contact. The socket housing 7 is constructed in accordance with German Industrial Standards DIN 41 612, and such socket housing design is well accepted. A prior art socket contact which was installed in the housing, could not accept a long pin contact, but the present socket contact 4 can do this.

Figure 8:
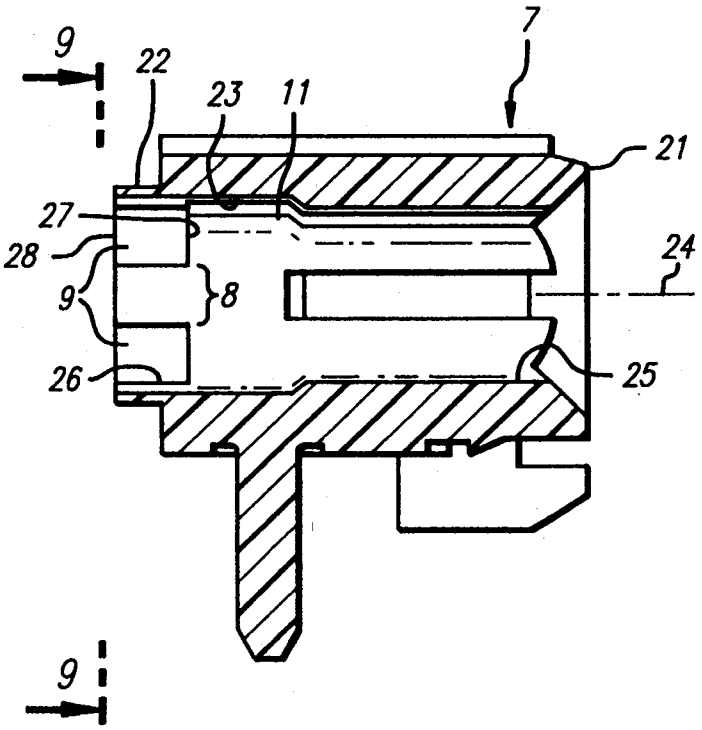
FIG. 8 PRIOR ART
FIG. 8 is a view taken on the line VIII—VIII of FIG. 7.
Figure 7:
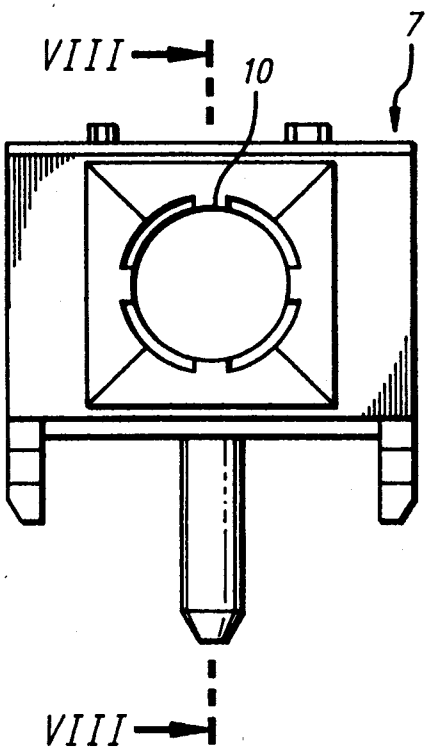
FIG. 7 PRIOR ART
FIG. 7 is a front elevation view of a socket housing of the prior art.

As shown in FIG. 8 the socket housing 7 has front and rear ends 21, 22, and has a through passage 23 that extends between the ends. The passage has an axis 24 and has passage walls forming front and rear end portions 25, 26. The passage rear end portion 26 includes four radially inwardly projecting ribs 9 that have front and rear ends 27, 28, the ribs being angularly or radially spaced apart by distances B. The ribs are designed to lock the prior art socket contact in place.

Figure 2:
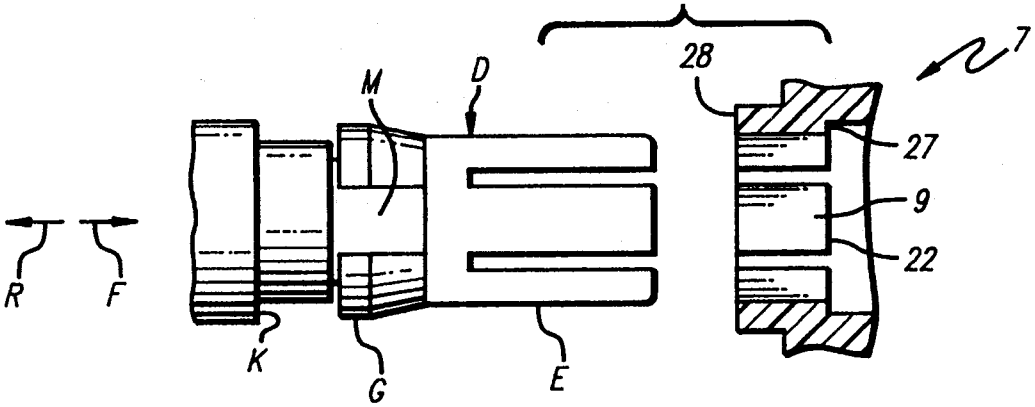
FIG. 2 PRIOR ART
FIG. 2 is a partial side elevation view of a socket contact constructed in accordance with the prior art.
Figure 3:
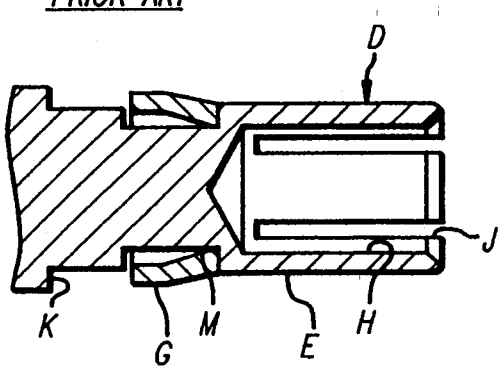
FIG. 3 PRIOR ART
FIG. 3 is a partial sectional view of the socket contact of FIG. 2.

FIGS. 2 and 3 show some details of the prior art socket contact D which was designed to mount in the prior art socket housing.. The socket contact D includes a front part E that forms a socket, and a middle that forms a groove M lying rearward of the front portion. A spring clip G lies in the groove M and serves to lock the socket contact in the socket housing. As shown in FIG. 3, the front part E has a large cylindrical hole H and has slots J in the walls of the hole, to form a socket. The portion of the socket contact rearward of the front part E is solid, so the deep groove M can be formed in it. The socket contact also includes a shoulder K behind the clip G. When the socket contact D was inserted in a forward direction F into the socket housing 7, the spring device G snapped behind the rear ends 22 of the ribs 9 to prevent movement in a rearward direction R. At that time, the shoulder K abutted the rear ends 28 of the ribs to prevent forward movement of the socket contact.

Although the socket contact was securely held in position when inserted into the housing, the need for a groove M to hold the spring clip G resulted in a major disadvantage. The disadvantage is that the groove limited the axial length of the hole H. If the hole H were extended further rearwardly, this would result in very thin walls within the groove M, resulting in an easily damaged socket contact. The outside diameter at the groove M is about 25 percent less than the outside diameter at the rear of the front part E. The present invention is directed to a new socket contact which can fit in the prior art socket housing 7 in place of the prior art socket contact, and which can have a hole of substantially the same diameter as the prior art hole H, but with such hole extending further rearwardly or through the entire length of the socket contact.

Figure 4:
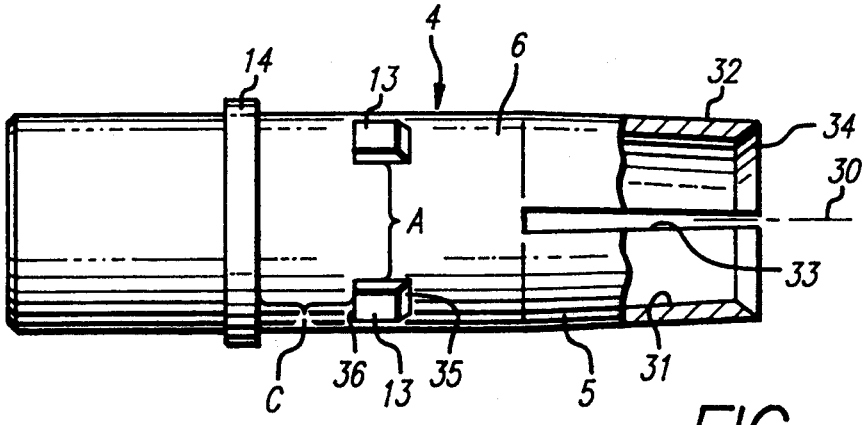
FIG. 4 is a partially sectional side elevation view of a socket contact constructed in accordance with the present invention.
Figure 5:
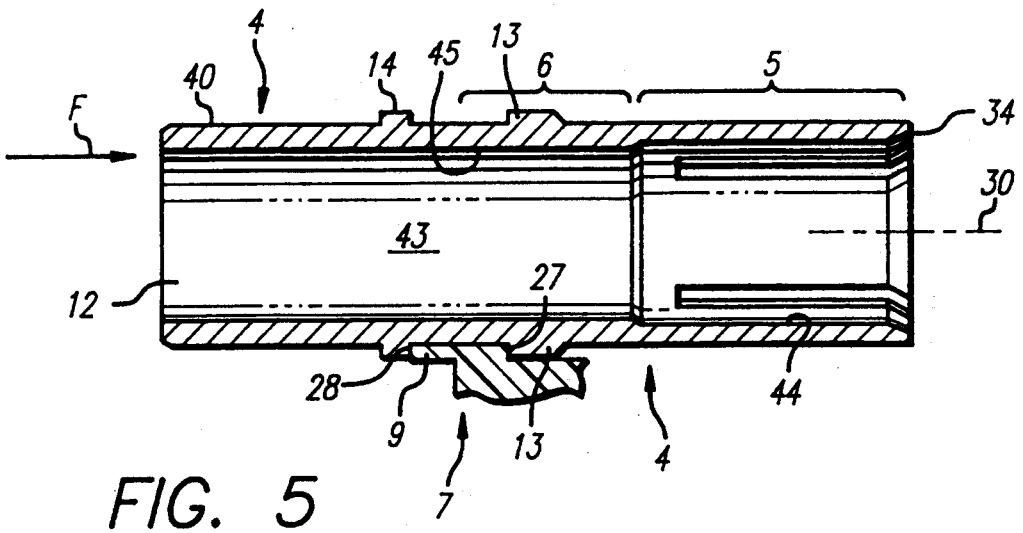
FIG. 5 is a sectional view of the socket contact of FIG. 4, and of a portion of the socket housing in which it fits, but with the tines in their original orientation.
Figure 6:
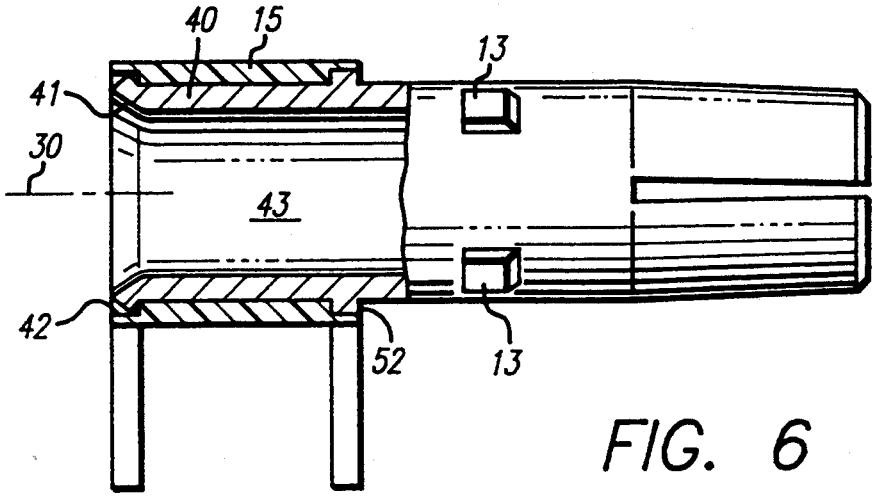
FIG. 6 is a partially sectional side view of the socket contact of FIG. 5, showing a circuit board connector mounted thereon.
Figure 9:
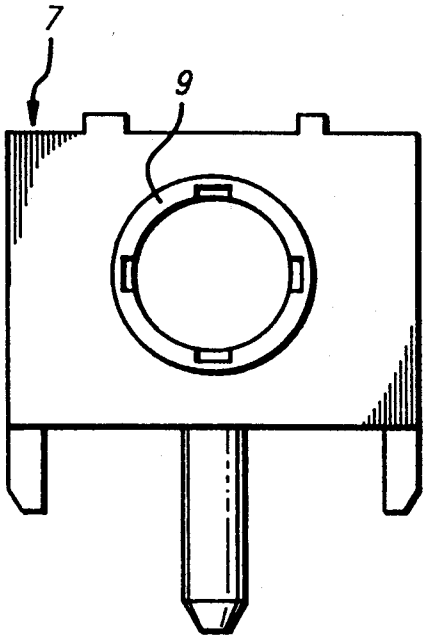
FIG. 9 PRIOR ART
FIG. 9 is a rear elevation view taken on line 9—9 of FIG. 8.

FIGS. 4–6 illustrate the new socket contact 4 of the present invention, which replaces the prior art socket contact. The new socket contact 4 comprises a substantially cylindrical tube having a tube axis 30 which lies coincident with the axis of the socket housing when the contact is installed therein. The tube has primarily cylindrical inside and outside surfaces 31, 32 centered on the axis. A front portion 5 of the socket contact has slots 33 forming a plurality of tines 34 for engaging a pin contact such as shown in FIG. 1, the tines being deformed slightly as shown. The tube formed by this socket contact has a middle portion 6 lying behind the front portion. The middle portion 6 has four projections 13 spaced circumferentially (about the circumference) about the tube and projecting from the outer or outside surface of the tube. The circumferential space A between adjacent projections is about the same as the circumferential length of each rib 9 (FIG. 8) of the second housing. The projections 13 are narrow enough so they can pass through the space B (FIG. 8) between adjacent ribs of the housing. This enables the socket contact to be projected forwardly through the passage of the housing, with the projections passing between ribs until the projections lie forward of the ribs.

Figure 10:
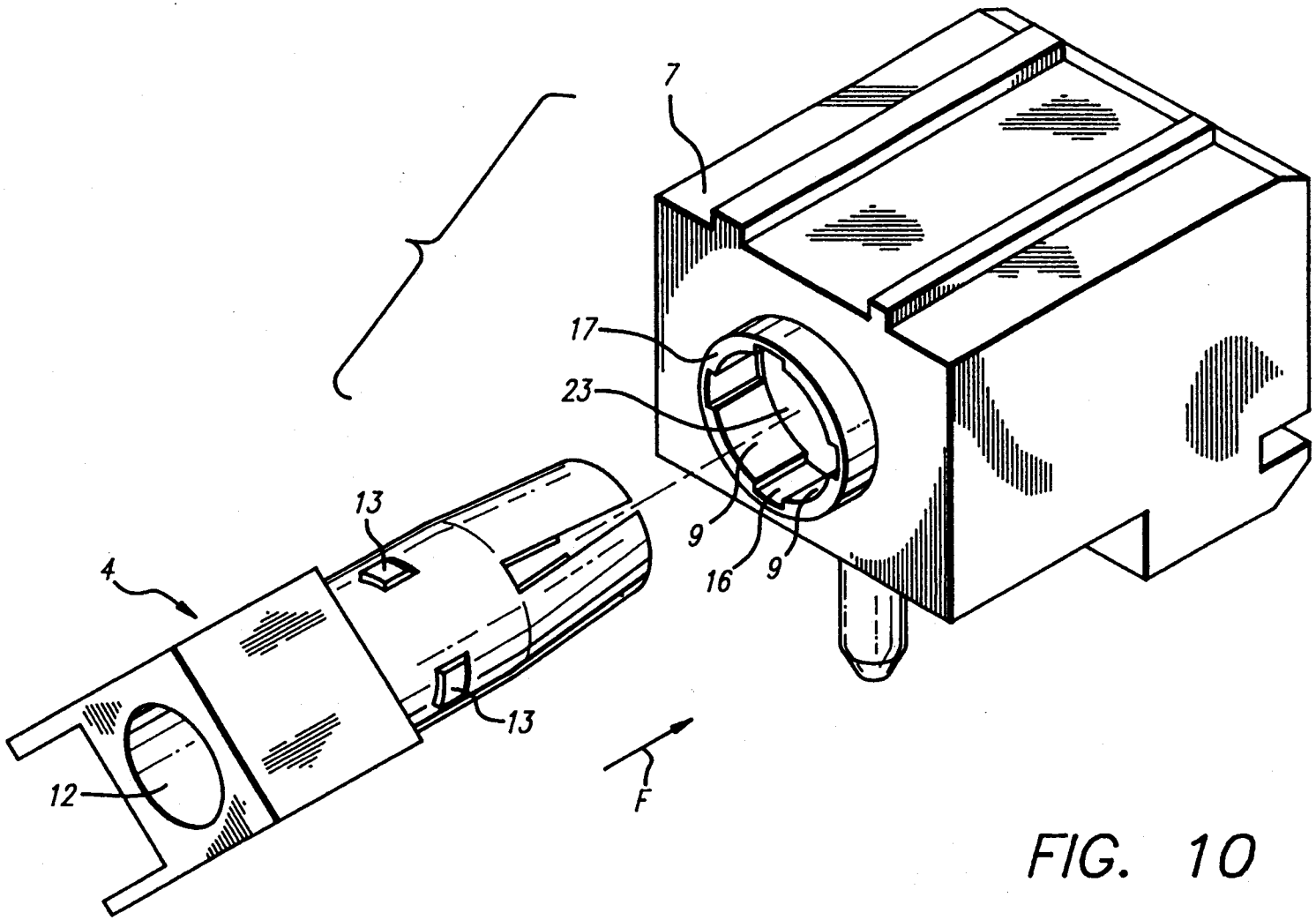
FIG. 10 is an exploded isometric view of a connector which includes the socket housing of FIG. 8 and the socket contact of FIG. 6.

FIG. 10 shows the socket contact 4 in the course of its projection in the forward direction F into the passage 23 of the socket housing. The socket contact has been oriented so the projections 13 can pass through the grooves 16 between ribs 9. After the socket contact has been fully projected so the projections 13 lie behind the ribs, the socket contact is turned 45° to the orientation shown in FIG. 11. In that orientation, each projection 13 is rotated to a position directly behind a corresponding housing rib 9.

FIG. 5 shows a portion of the housing 7 with the socket contact 4 fully installed thereon. A collar 14 on the socket contact abuts the forward ends 28 of the ribs while the projections 13 abut the rearward ends 27 of the ribs. FIG. 6 shows a circuit board connector 15 mounted on a rear portion 40 of the socket contact. The extreme rear end 41 of the socket contact is deformed radially outwardly, to abut the rear of the circuit board connector and prevent it from sliding off. The circuit board connector has a groove 42 in its rear which receives the deformed rear of the socket contact, to avoid any projecting portion.

The hole 43 formed through the length of the socket contact is of substantially constant diameter. The front portion 44 of the hole, which lies within the front portion 5 of the socket contact, has about the same diameter as the middle portion 45 of the hole which lies within the projections 13. Actually, the hole is tapered at the front after the tines 34 have been slightly bent as shown in FIGS. 4 and 6. Also, applicant prefers to form the middle hole portion 45 so its diameter is slightly smaller (most preferably about 5 percent smaller, and preferably no more than 10 percent smaller) than at the rear of the tines 34, to provide guidance for the front of the pin contact. The fact that no groove is formed in the socket contact, but the only locking device is the projections 13, results in a thick wall at the middle hole portion 45. Although it is possible to close the rear end of the socket contact, applicant prefers to leave it open, so it can be used to pass a very long pin or cables of a diameter about the same as that of the hole.

It is noted that the projections 13 of FIG. 6 have front ends 50 that are angled from a radial direction, to facilitate entrance into the housing. The rear ends 51 extend radially as does the front 52 of the collar, to firmly abut the ribs.

Thus, the invention provides a solution to the problem of modifying a prior art connector so as to be able to use the same standard and accepted housing, while modifying the socket contact to accept much longer plugs without creating a fragile socket contact. This is accomplished by a new socket contact of largely tubular shape which has outward projections at its middle portion that pass through gaps left between ribs of the housing, so the new socket contact can be installed by projecting it into place in a turned position, and then turning the socket contact about 45° into an aligned position wherein the projections lie against the rear of the ribs.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector which includes a standard housing for receiving and holding a socket terminal, where the standard housing has front and rear ends and has walls forming a horizontal through passage extending between said ends, said passage having a housing axis and having passage front and rear end portions, with said passage rear end portion including a plurality of radially inwardly projecting ribs that are circumferentially spaced and that have front and rear ends, with said ribs constructed to receive a prior art socket contact that has a spring clip that can snap forward of said ribs, characterized by:

a socket contact which comprises a substantially cylindrical tube having a tube axis, said tube having a front portion with a plurality of axially-extending slots forming a plurality of tines for engaging a pin contact, said tube having a middle portion lying behind said front portion and said socket terminal having a plurality of projections spaced about said tube and projecting radially outwardly from the outside surface of said middle portion, said projections each having rear ends, and said projections each being narrow enough and being circumferentially spaced about said tube axis so said projections can slide axially between pairs of said ribs of said standard housing to locations where said projection rear ends lie immediately forward of said rib front ends, said socket contact including a collar lying rearward of said projection rear ends by a distance equal to the distance between said rib front and rear ends so said collar lies against the rear ends of said ribs;

said tube has a rear portion lying rearward of said collar and has an extreme rear end that is slightly outwardly deformed; and including a connector device having an inside diameter equal to the outside diameter of said tube and lying around said tube rear portion, with said device having a front end abutting said collar and a rear end having a groove that receives and abuts said outwardly deformed tube extreme end.

2. A connector comprising a standard housing of insulative material that has front and rear ends, a horizontal axis, and a horizontal passage centered on said axis and extending between said ends, said passage having front and rear end portions with said passage rear end portion including four radially inwardly projecting ribs having front and rear ends and being designed to receive a prior art socket contact that has a spring clip that can deflect around said ribs to lie against the rib front ends, characterized by:

a socket contact of metal material which has primarily cylindrical inside and outside surfaces centered on said axis, and which has front, middle, and rear portions with said front and middle portions lying in said housing passage and with said rear portion projecting rearwardly of said passage, said front portion having a plurality of axially-extending slots forming a plurality of tines for receiving and engaging a pin contact, and said middle having four projections on said outside surface, said projections constructed to pass between said ribs when said socket terminal is slid forwardly into said housing passage, said socket contact including a collar lying rearward of said projection rear ends by a distance equal to the distance between said rib front and rear ends to lie against the rear ends of said ribs.

3. The connector described in claim 2 wherein:

said socket contact middle has an inside diameter which is about 5 percent smaller than the inside diameter at the rear of said front portion, but the outside diameter of said socket contact is the same at the rear of said front portion as at said middle in regions of said middle that lie away from said projections.

* * * * *